US006457951B2

(12) United States Patent
Rennett et al.

(10) Patent No.: US 6,457,951 B2
(45) Date of Patent: Oct. 1, 2002

(54) MAGNETICALLY COUPLED CANNED ROTARY PUMP

(75) Inventors: Ulrich Rennett, Schwalmtal (DE); Manfred Sett, Kempen (DE); Alfred Mersch, Duisburg (DE)

(73) Assignee: ITT Richter Chemie-Technik GmbH, Kempen (DE)

( * ) Notice: Subject to any disclaimer, the term of this patent is extended or adjusted under 35 U.S.C. 154(b) by 8 days.

(21) Appl. No.: 09/862,432

(22) Filed: May 21, 2001

(30) Foreign Application Priority Data

May 22, 2000 (DE) ..... 100 24 955

(51) Int. Cl.[7] ..... F04B 17/00; F04B 35/00

(52) U.S. Cl. ..... 417/366; 417/365; 417/368; 417/420

(58) Field of Search ..... 417/366, 365, 417/368, 420

(56) References Cited

U.S. PATENT DOCUMENTS 4,080,112 A * 3/1978 Zimmermann ..... 415/104
4,752,194 A * 6/1988 Wienen et al. ..... 417/420
4,812,108 A 3/1989 Kotera ..... 417/368
5,163,812 A * 11/1992 Klaus ..... 384/404
5,248,245 A * 9/1993 Behnke et al. ..... 415/110

FOREIGN PATENT DOCUMENTS

DE 39 43 273 7/1991
DE 40 09 199 9/1991

* cited by examiner

*Primary Examiner*—Charles G. Freay
*Assistant Examiner*—Michael K. Gray
(74) *Attorney, Agent, or Firm*—Herbert Dubno; Andrew Wilford

(57) ABSTRACT

A pump has a housing plate, a housing can fixed to the plate and defining a chamber on a back face thereof, a bearing sleeve in the can fixed to the plate and extending rearward from the back face along an axis, and a rotor shaft extending axially through the sleeve. Bearings support the rotor shaft in the sleeve and an impeller is carried on the rotor-shaft front end. A rotor body fixed to the shaft rear end extends axially forward in the can around the bearing sleeve. The rotor body defines an annular space around the bearing sleeve and is formed with at least one axially throughgoing passage open axially forward into the space and axially rearward into the can. A vane in the passage is angled for pumping liquid from inside the can axially forward into the space on rotation of the rotor about the axis.

8 Claims, 1 Drawing Sheet

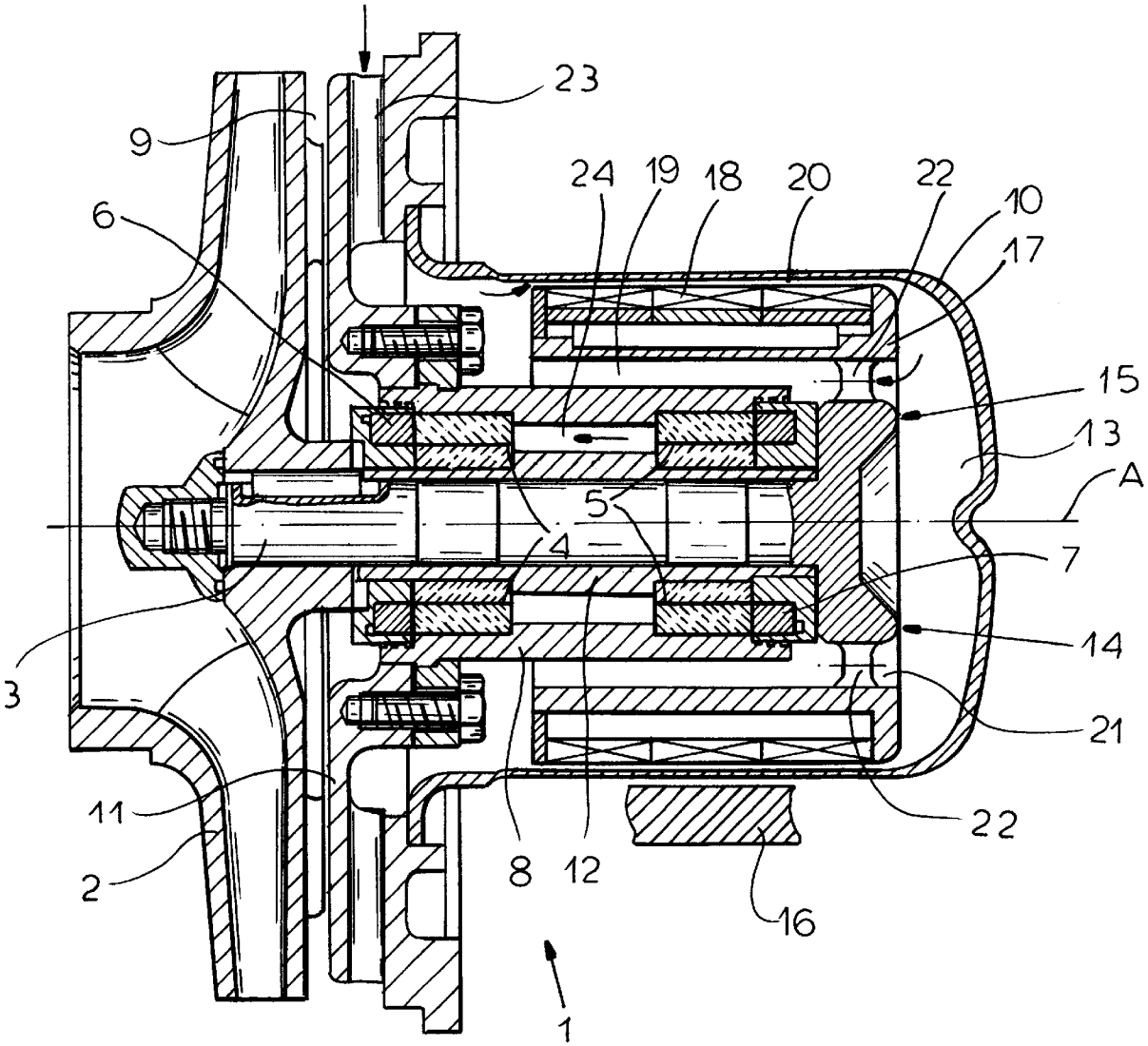
15
13
A
7
14
21
10
17
22
22
20
16
18
19
5
24
12
23
4
1
8
9
6
11
2
3

MAGNETICALLY COUPLED CANNED ROTARY PUMP

FIELD OF THE INVENTION

The present invention relates to a pump. More particularly this invention concerns a rotary pump of the canned type with magnetic coupling to a pump rotor.

BACKGROUND OF THE INVENTION

A standard magnetically coupled can-type pump has a housing plate having a front face and a back face, a can fixed to the plate and defining a chamber on the back face thereof, and a bearing sleeve in the can fixed to the plate and extending rearward from the back face thereof along an axis. A rotor shaft extending axially through the sleeve is supported by bearings in the sleeve for rotation therein about the axis. An impeller is provided on a front end of the rotor shaft in a pump chamber at the front face of the housing plate. A rotor body fixed to a rear end of the shaft extends axially forward in the can around the bearing sleeve. It carries a plurality of permanent magnets that coact with another rotor or stator outside the can to rotate the impeller.

The rotor of the pump is therefore such that no electricity flows in it to create a shock hazard so that it can run wet. Thus the interior of the can is filled with the liquid being moved by the pump, for instance coolant water or lubricating oil. The rotor body is formed with one or more axially throughgoing passages and radially extending vanes are provided on the rear end of the rotor body. As the rotor spins, the vanes project fluid outward, pulling more axially in through the rotor body and thereby cooling and/or lubricating it and its bearings.

Such radial vanes have only limited pumping capacity at high pressure. Making them bigger, while it increases the volume of liquid moved, increases the amount of cavitation and the load on the rotor, decreasing pump efficiency. Furthermore the liquid is moved most forcibly between the rear end of the pump and the can, not in the central region of the body where such movement is most needed.

OBJECTS OF THE INVENTION

It is therefore an object of the present invention to provide an improved can-type pump.

Another object is the provision of such an improved can-type pump which overcomes the above-given disadvantages, that is which moves the liquid at a good rate through the center of the rotor so as to efficiently cool, flush, and lubricate it.

SUMMARY OF THE INVENTION

A pump has according to the invention a housing plate having a front face and a back face, a housing can fixed to the plate and defining a chamber on the back face thereof, a bearing sleeve in the can fixed to the plate and extending rearward from the back face thereof along an axis, and a rotor shaft extending axially through the sleeve and having a front end and a rear end. Bearings support the rotor shaft in the sleeve for rotation therein about the axis and an impeller is carried on the rotor-shaft front end in a pump chamber at the front face of the housing plate. A rotor body fixed to the shaft rear end extends axially forward in the can around the bearing sleeve. The rotor body defines an annular space around the bearing sleeve and is formed with at least one axially throughgoing passage open axially forward into the space and axially rearward into the can. In accordance with the invention a vane in the passage is angled for pumping liquid from inside the can axially forward into the space on rotation of the rotor about the axis.

The axially effective vanes are relatively close to the rotation axis of the rotation-symmetrical subassembly comprised of the shaft and rotor body. The vanes can be planar or curved and extend basically along planes forming angles of 5° to 15° with the rotor axis. Such vanes move a considerable volume of liquid with minimal cavitation, and direct the flow to the core of the rotor so as to drive it through the bearings and parts most needing lubrication and/or cooling. In fact the vanes can form the only connection between the rotor shaft, which can include a sleeve, and the rotor body, in which case the passage is annular, a plurality of the vanes are used, and they are angularly equispaced about the rotor axis. Since there are no vanes on the rear end of the rotor body, erosion of the inner face of the rear end of the can is reduced greatly. Overall the pump according to the invention will use less work to move more liquid than the prior-art systems.

The sleeve according to the invention has a rear end open into the space axially forward of the vane so that the liquid pumped by the vanes enters the rear end of the bearing sleeve and lubricates the bearings.

The rotor body carries magnets that cooperate with a magnetic rotor rotatable outside the can about the axis. In addition the bearings are ceramic. Thus whether oil or water is flowed through the rotor, the bearings will not be damaged and there will be no chance of a short circuit.

The plate according to the invention is formed with a passage communicating with an interior of the can forward of the rotor body and the pump chamber. In addition the rotor body is formed integrally with the vane and with a sleeve fixed to and snugly coaxially surrounding the shaft. The can is nonmagnetic and generally cylindrical.

BRIEF DESCRIPTION OF THE DRAWING

The above and other objects, features, and advantages will become more readily apparent from the following description, reference being made to the accompanying drawing whose sole figure is a partly diagrammatic axial section through a pump according to the invention.

SPECIFIC DESCRIPTION

As seen in the drawing, a rotary pump 1 has an axial-input radial-output impeller 2 carried on a front end of a shaft 3 of a magnetically driven rotor 14 and rotatable thereby about an axis A. The shaft 3 extends axially through a stationary housing wall 11 on whose front side is a pump chamber 9 holding the impeller 2 and on whose back side is secured a closed dielectric can 10 surrounding the rotor 14. A bearing sleeve 8 is fixed to the wall 11 and extends outward therefrom along the axis A and another sleeve 12 is fixed to and surrounds the shaft 3.

The rotor 14 is supported on the sleeve 8 by two-part ceramic radial-force bearings 4 and 5 flanked by two ceramic axial-force bearings 6 and 7. The bearings 4 through 9 engage the shaft sleeve 12 and allow the rotor 14 to rotate freely about the axis A. The rotor 14 has a rear end 15 connected to the rear end of a cup-shaped magnet holder or body 17 that coaxially surrounds the rear end of the bearing sleeve 8 and that carries a plurality of permanent magnets 18 that cooperate with a drive element 16 that is rotated about the axis A outside the can 10 by a motor as known per se. The rotor body 17 defines with the bearing sleeve 8 an axially extending annular space 19 and, with the can 10 and radially outward therefrom, an axially extending annular space 20. The front ends of the spaces 19 and 20 communicate with the pump chamber 9 via a passage 23 and their rear ends open into a chamber 13 defined between the inner face of the end of the can 10 and the rear face of the rotor body 17. An annular and axially extending inner space 24 holding the bearings 4 through 9 is defined between the rotor sleeve 12 and the housing sleeve 8.

According to the invention an annular passage 21 connects the rear end of the space 19 with the chamber 13 at the rear end of the can 10. The passage 21 is provided with two to four, here three, angled vanes 22 that extend at angles of between 5° and 15° to respective planes including the axis A. Thus, when the rotor 14 turns in a standard forward direction, the vanes 22 draw liquid from the chamber 13 in and force it not 20 only inward through the space 19, but forward into the space 24 between the bearing sleeve 24 and the rotor sleeve 12. This serves to lubricate and/or cool the bearings 4–7.

We claim:

1. A pump comprising:

a housing plate having a front face and a back face;

a housing can fixed to the plate and defining a chamber on the back face thereof;

a bearing sleeve in the can fixed to the plate and extending rearward from the back face thereof along an axis;

a rotor shaft extending axially through the sleeve and having a front end and a rear end;

bearings supporting the rotor shaft in the sleeve for rotation therein about the axis;

an impeller on the rotor-shaft front end in a pump chamber at the front face of the housing plate;

a rotor body fixed to the shaft rear end and extending axially forward in the can around the bearing sleeve, the rotor body defining an annular space around the bearing sleeve and being formed with at least one axially throughgoing passage open axially forward into the space and axially rearward into the can; and means including a vane in the passage angled for pumping liquid from inside the can axially forward into the space on rotation of the rotor about the axis.

2. The pump defined in claim 1 wherein the passage is annular and is provided with at least two of the vanes angularly offset from each other.

3. The pump defined in claim 1 wherein the sleeve has a rear end open into the space axially forward of the vane, whereby the liquid pumped by the vanes enters the rear end of the bearing sleeve and lubricates the bearings.

4. The pump defined in claim 1, further comprising magnets carried on the rotor body; and a magnetic rotor rotatable outside the can about the axis.

5. The pump defined in claim 1 wherein the bearings are ceramic.

6. The pump defined in claim 1 wherein the plate is formed with a passage communicating with an interior of the can forward of the rotor body.

7. The pump defined in claim 1 wherein the rotor body is formed integrally with the vane and with a sleeve fixed to and snugly coaxially surrounding the shaft.

8. The pump defined in claim 1 wherein the can is nonmagnetic and generally cylindrical.

* * * * *